US012312727B2

(12) United States Patent
Hu et al.

(10) Patent No.: US 12,312,727 B2
(45) Date of Patent: May 27, 2025

(54) AUTOMATIC WASH AND DRY PROCESS IN A WASHING MACHINE APPLIANCE

(71) Applicant: Haier US Appliance Solutions, Inc., Wilmington, DE (US)

(72) Inventors: Haitian Hu, Louisville, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 293 days.

(21) Appl. No.: 17/960,564

(22) Filed: Oct. 5, 2022

(65) Prior Publication Data

US 2024/0117547 A1 Apr. 11, 2024

(51) Int. Cl.

| | |
|---|---|
| ***D06F 25/00*** | (2006.01) |
| ***D06F 33/68*** | (2020.01) |
| ***D06F 34/05*** | (2020.01) |
| ***D06F 34/18*** | (2020.01) |
| ***D06F 37/30*** | (2020.01) |
| *D06F 101/20* | (2020.01) |
| *D06F 103/04* | (2020.01) |
| *D06F 105/30* | (2020.01) |
| *D06F 105/46* | (2020.01) |
| *D06F 105/52* | (2020.01) |

(52) U.S. Cl.

CPC ..... *D06F 33/68* (2020.02); *D06F 25/00* (2013.01); *D06F 34/05* (2020.02); *D06F 34/18* (2020.02); *D06F 37/304* (2013.01); *D06F 2101/20* (2020.02); *D06F 2103/04* (2020.02); *D06F 2105/30* (2020.02); *D06F 2105/46* (2020.02); *D06F 2105/52* (2020.02)

(58) Field of Classification Search

None

See application file for complete search history.

(56) References Cited

U.S. PATENT DOCUMENTS

| | | | | |
|---|---|---|---|---|
| 2010/0205825 | A1* | 8/2010 | Ashrafzadeh ..... | D06F 58/36 34/88 |
| 2012/0084995 | A1 | 4/2012 | Vogel | |
| 2015/0292134 | A1 | 10/2015 | Dale et al. | |
| 2018/0305851 | A1 | 10/2018 | Kwon et al. | |

FOREIGN PATENT DOCUMENTS

| | | | |
|---|---|---|---|
| CA | 2166526 | C | 8/2004 |
| CN | 101725010 | A | 6/2010 |
| JP | 2008243088 | A | 10/2008 |

* cited by examiner

*Primary Examiner* — Levon J Shahinian

(74) *Attorney, Agent, or Firm* — Dority & Manning, P.A.

(57) ABSTRACT

A washing machine appliance includes a wash tub positioned within a cabinet, a wash basket rotatably mounted within the wash tub, a blower operably coupled to the wash basket, a motor assembly mechanically coupled to the wash basket for rotating the wash basket, and a controller. The blower is configured to introduce air into the wash basket. The controller is configured to initiate a wash cycle for cleaning the load of clothes, determine that air dry conditions are satisfied, and perform an air dry operation after completion of the wash cycle in response to determining that the air dry conditions are satisfied. The air dry operation may include operating the blower to circulate the air within the wash basket and operating the motor assembly to tumble the load of clothes. A method of operating a washing machine appliance is also provided.

14 Claims, 5 Drawing Sheets

AUTOMATIC WASH AND DRY PROCESS IN A WASHING MACHINE APPLIANCE

FIELD OF THE INVENTION

The present subject matter relates generally to washing machine appliances, and more particularly to automated wash and dry operations in washing machine appliances.

BACKGROUND OF THE INVENTION

Washing machine appliances generally operate to wash articles, such as clothes, by rotating a wash basket inside a wash tub with wash fluid inside. In some washing machine appliances, additional features and operations are also available. Generally, articles in the wash basket following a washing machine appliance operation are wet or damp, and require drying, such as in a dryer appliance. A user generally moves the wet articles from the wash tub to a dryer appliance to dry the articles following completion of the washing machine appliance operation.

In some situations, a user could benefit from performing a washing operation within a short time frame, such as when articles are soiled in the evening and require washing by the next morning. Challenges exist in that articles typically need to be moved from the washing machine appliance to the dryer appliance, but performing that overnight is inconvenient or challenging. Certain conventional washing machine appliances include features for at least partially drying wet articles in a wash basket by circulating air and/or tumbling the wash basket.

Accordingly, a washing machine appliance that improved visibility of features would be useful. Additionally or alternatively, a system within a household that increased utilization of washing machine appliance features would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a wash tub positioned within a cabinet, a wash basket rotatably mounted within the wash tub, a blower operably coupled to the wash basket, a motor assembly mechanically coupled to the wash basket for selectively rotating the wash basket, and a controller. The wash basket may define a wash chamber for receiving a load of clothes. The blower may be configured to introduce air into the wash basket. The controller may be in operative communication with the blower and the motor assembly. The controller may be configured to initiate a wash cycle for cleaning the load of clothes, determine that air dry conditions are satisfied, and perform an air dry operation after completion of the wash cycle in response to determining that the air dry conditions are satisfied. The air dry operation may include operating the blower to circulate the air within the wash basket and operating the motor assembly to tumble the load of clothes.

In another exemplary aspect of the present disclosure, a method of operating a washing machine appliance is provided. The washing machine appliance may have a wash basket rotatably received within the wash tub for rotation about a substantially horizontal axis by a motor assembly and may have a blower configured to introduce air into the wash basket. The method may include the steps of initiating a wash cycle for cleaning a load of clothes in the wash basket, determining that air dry conditions are satisfied, and performing an air dry operation after completion of the wash cycle in response to determining that the air dry conditions are satisfied. The air dry operation may include operating the blower to circulate air within the wash basket and operating the motor assembly to tumble the load of clothes.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Use of the same or similar reference numerals in the figures denotes the same or similar features unless the context indicates otherwise.

DETAILED DESCRIPTION

Figure 1:
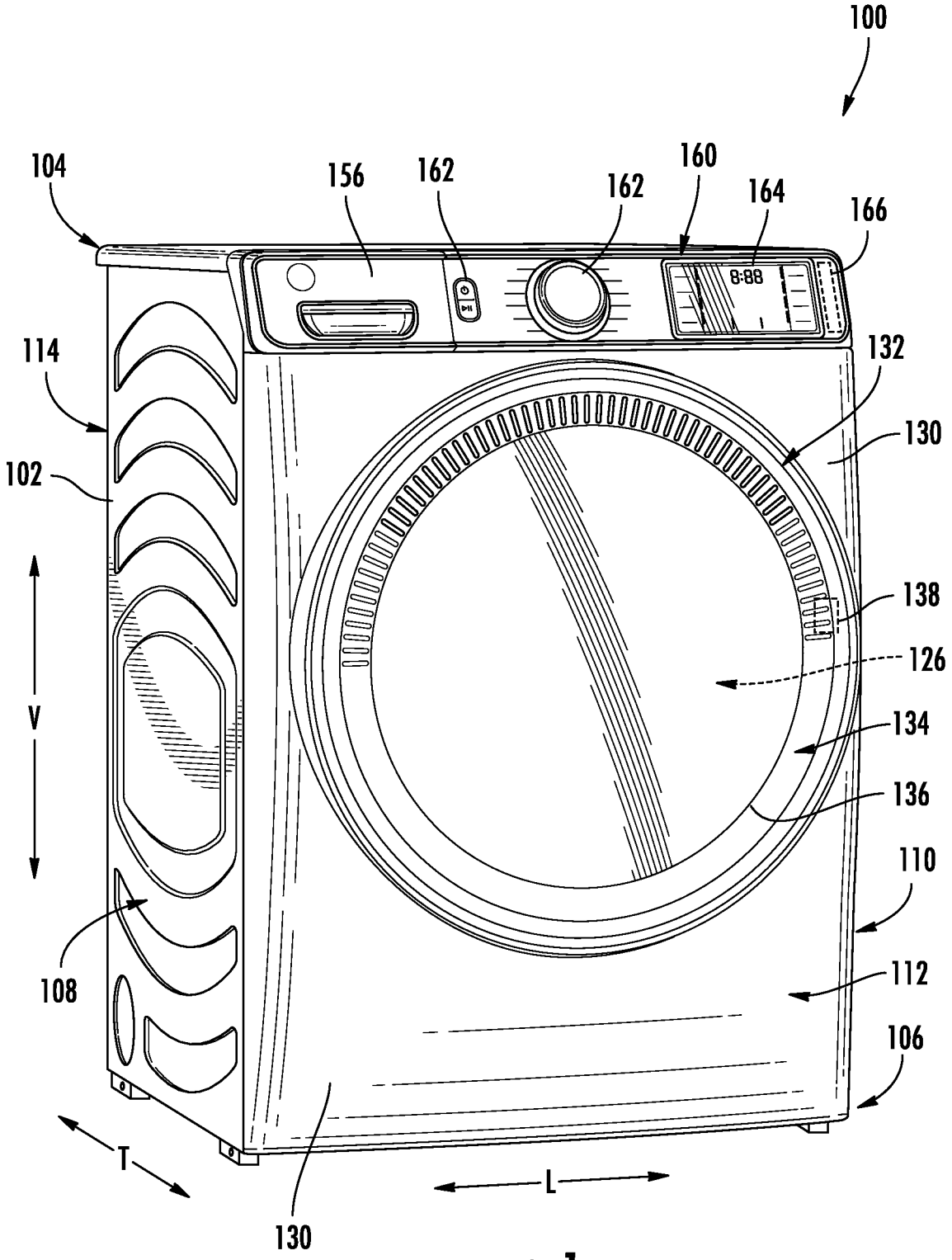
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

The word "exemplary" is used herein to mean "serving as an example, instance, or illustration." In addition, references to "an embodiment" or "one embodiment" do not necessarily refer to the same embodiment, although they may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The present invention advantageously provides a washing machine appliance that may provide increased opportunities for use of an air dry operation. For example, if air dry conditions are satisfied, a washing machine according to embodiments described herein may utilize an air dry function automatically. Users unaware of the air dry operation feature or unsure of when to use the air dry operation feature would receive the benefits of it automatically. Advantageously, washing and drying of loads of clothes with proper conditions would be more readily available due to automatic usage of the air dry operation following a wash cycle. Further, a user may be able to cancel or pause or refuse an air dry operation following a wash cycle by direct input. For example, users with back-to-back sports competitions may need to have team uniforms washed, dried, and ready overnight, and embodiments described herein would detect the opportunity to use the air dry cycle following a wash cycle and automatically move to the air dry operation following completion of the wash cycle, thus allowing the users to sleep instead of waking up to switch the load of uniforms from the washer to the dryer. Consumer feedback may also be used to detect when to use the air dry operation in embodiments described herein.

As will be understood by those skilled in the art, front loading washing machine appliance 100 is provided by way of example only, and the present subject matter may be used in any suitable washing machine appliance. Thus, the present subject matter may be used with other washing machine appliances having different configurations, such as top load washing machines. Washing machine appliance 100 will be described below, with the understanding that other embodiments may include or be provided as another suitable household appliance (e.g., defining an internal chamber).

Figure 2:
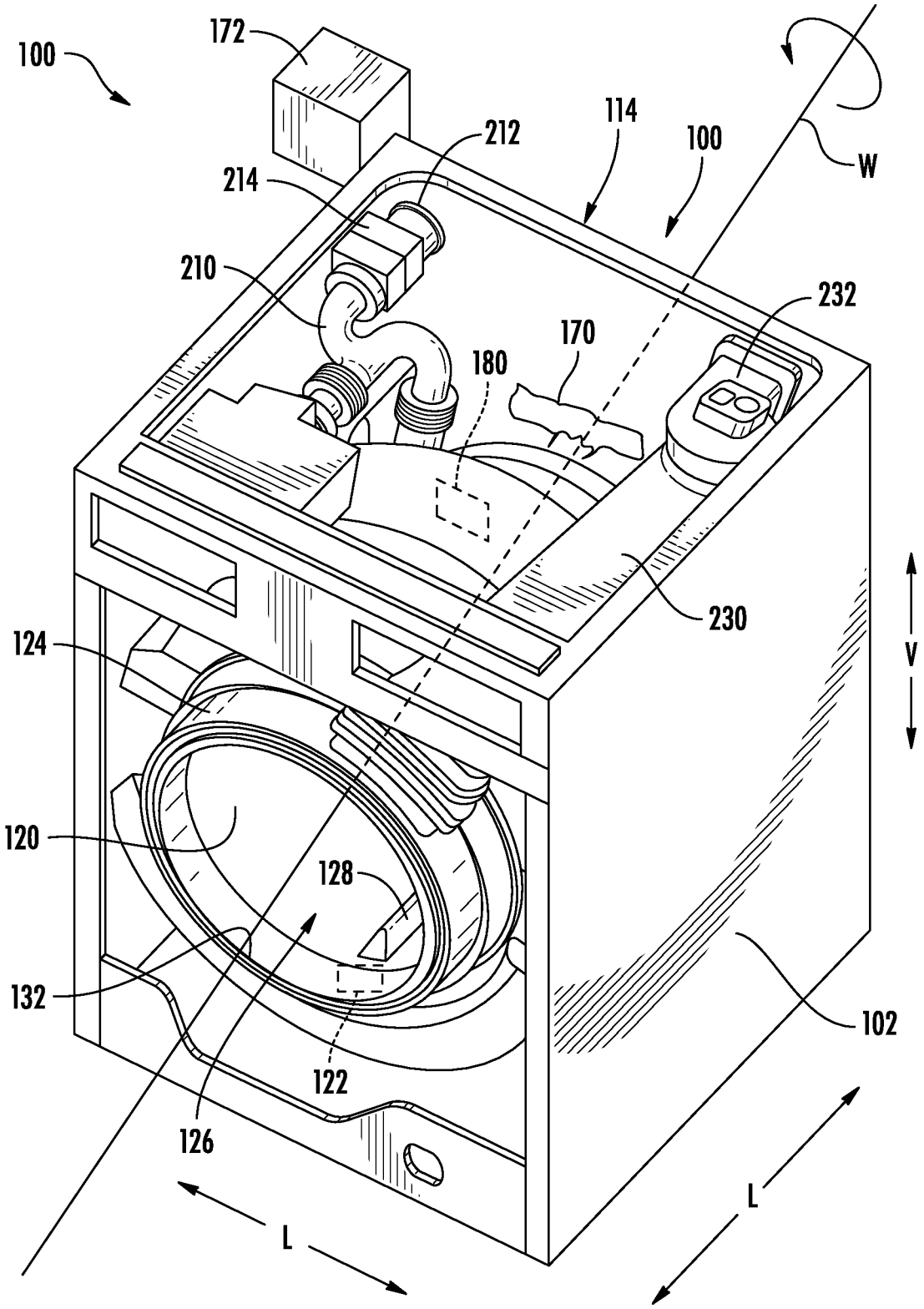
FIG. 2 provides a perspective view of a portion of a washing machine appliance according to exemplary embodiments of the present disclosure.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a perspective view of a portion of an example washing machine appliance 100. As illustrated, washing machine appliance 100 generally defines a vertical direction V, a lateral direction L, and a transverse direction T, each of which is mutually perpendicular, such that an orthogonal coordinate system is generally defined.

According to exemplary embodiments, washing machine appliance 100 includes a cabinet 102 that is generally configured for containing and/or supporting various components of washing machine appliance 100 and which may also define one or more internal chambers or compartments of washing machine appliance 100. In this regard, as used herein, the terms "cabinet," "housing," and the like are generally intended to refer to an outer frame or support structure for washing machine appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include an open structure supporting various elements of washing machine appliance 100. By contrast, cabinet 102 may enclose some or all portions of an interior of cabinet 102. It should be appreciated that cabinet 102 may have any suitable size, shape, and configuration while remaining within the scope of the present subject matter. For example, a portion of cabinet 102 is shown in FIG. 2, with some portions of cabinet 102 removed to show some internal structures, as will be described in more detail below As illustrated, cabinet 102 generally extends between a top 104 and a bottom 106 along the vertical direction V, between a first side 108 (e.g., the left side when viewed from the front as in FIG. 1) and a second side 110 (e.g., the right side when viewed from the front as in FIG. 1) along the lateral direction L, and between a front 112 and a rear 114 along the transverse direction T. In general, terms such as "left," "right," "front," "rear," "top," or "bottom" are used with reference to the perspective of a user accessing washing machine appliance 100.

Referring to FIG. 2, a wash basket 120 is rotatably mounted within cabinet 102 such that it is rotatable about an axis of rotation W. Washing machine appliance may be referred to as a horizontal axis clothes washer, with axis of rotation W being substantially horizontal as is known in the art. A motor assembly 170, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Washing machine appliance 100 may further include a latch assembly 138 (see FIG. 1) that is mounted to cabinet 102 and/or door 134 for selectively locking door 134 in the closed position and/or confirming that door 134 is in the closed position. Latch assembly 138 may be desirable, for example, to ensure only secured access to wash chamber 126 or to otherwise ensure and verify that door 134 is closed during certain operating cycles or events.

Washing machine appliance 100 may include a motor assembly 170. Motor assembly 170 is mechanically coupled to wash basket 120 for selectively rotating the wash basket 120. For example, washing machine appliance 100 may include a detergent drawer 156, a water inlet (not shown), and a water outlet (not shown) to provide wash fluid to wash basket 120 during a wash cycle. During the wash cycle, wash basket 120 may be rotated by motor assembly 170 to move wash fluid from wash basket 120 into wash tub 124 and through a drain hose (not shown), and to an external drain 172.

During operation of washing machine appliance 100, laundry items are loaded into wash basket 120 through opening 132, and washing operation is initiated through operator manipulation of one or more input selectors or using a remote device (see below). Wash tub 124 is filled with water, detergent, and/or other fluid additives, e.g., via a spout (not shown) and/or a detergent drawer 156. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120. Motor assembly 170 may aid in agitation by rotating wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds, and a drain assembly (not shown) may discharge wash fluid from a sump (not shown). After articles disposed in wash basket 120 are cleaned, washed, and/or rinsed, the user can remove the articles from wash basket 120, e.g., by opening door 134 and reaching into wash basket 120 through opening 132.

In some embodiments, washing machine appliance 100 may include a camera or camera assembly 180. Generally, camera 180 may be any type of device suitable for capturing at least one image or video. As an example, camera 180 may be a video camera or a digital camera with an electronic image sensor [e.g., a charge coupled device (CCD) or a CMOS sensor]. Although the term "image" is used herein, it should be appreciated that according to exemplary embodiments, camera 180 may take any suitable number or sequence of two-dimensional images, videos, or other visual representations of wash basket 120 or items (e.g., a load of clothes) positioned therein. For example, the one or more images may include a video feed or a series of sequential static images obtained by camera 180 that may be transmitted to controller 166 (e.g., as a data signal) for analysis or other manipulation. Optionally, one or more light sources (not shown) may be provided with or adjacent to the camera 180. During use, camera 180 may take images or video feed in coordination with the light sources such as to obtain higher quality or truer-to-color images of wash basket 120 or items therein or thereon.

In certain embodiments, a control panel 160, with at least one input selector 162, extends from front 112. Control panel 160 and input selector 162 collectively form a user interface input for operator selection of machine cycles and features. A display 164 of control panel 160 indicates selected features, operation mode, a countdown timer, or other items of interest to appliance users regarding operation. Operation of washing machine appliance 100 may be controlled by a controller 166 connected (e.g., electrically coupled) to control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive media) and microprocessor, such as a general or special purpose microprocessor operable to execute programming instructions or micro-control code associated with a selected machine cycles and features (e.g., as part of a washing operation). The memory may represent random access memory such as DRAM, or read only memory such as ROM or FLASH. In certain embodiments, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100 (e.g., one or more sensors, such as a pressure sensor 122 mounted to tub 124 in FIG. 2) may be in communication with controller 166 via one or more signal lines or shared communication busses.

Washing machine appliance 100 includes inlet ducting 210. The inlet ducting 210 includes an opening 212 extending through the housing, preferably through a rear 114 thereof, that allows air from outside the housing to be drawn into the washing machine for introduction into the drum during an air dry operation. If needed, a blower 214 may be added to enhance a movement of air from outside of cabinet 102 and into the wash basket 120. It is also contemplated that the inlet ducting 210 may be extended to pass in proximity or adjacent to the motor assembly 170 in order to pick up some latent heat through a heat exchange before introduction into the wash basket 120. Otherwise, it is intended that the air received from outside of cabinet 102 need not be subsequently heated before being introduced into wash basket 120.

Washing machine appliance 100 may also include outlet ducting 230. As shown, outlet ducting 230 is connected to wash basket 120 at a location spaced from inlet ducting 210. Outlet ducting 230 may be configured to receive air from the wash basket 120 at a location spaced from the inlet ducting 210. For example, the inlet ducting 210 may introduce air along a rear region of the wash basket 120 while the outlet duct 230 receives air from a perimeter of the wash basket 120 adjacent front opening 132. Outlet ducting 230 may be connected to an outlet blower 232. In some embodiments, outlet blower 232 may be a centrifugal blower that enhances the movement of the drying air through wash basket 120 while wash basket 120 is rotated.

Though two blowers 214 and 232 are shown in the embodiment of FIG. 2, embodiments described herein may have one or more blowers depending on the needs of the embodiment. An inlet blower 214 and an outlet blower 232 may serve to provide increased airflow during rotation of wash basket 120 during the air dry operation.

As will be appreciated, during the air dry operation, wash basket 120 is rotated by motor assembly 170 to institute a tumbling action on load (e.g., a load of clothes). During the air dry operation, the air is received from outside cabinet 102 by inlet ducting 210, directed through wash basket 120. Air may then be directed outwardly through outlet ducting 230 where it is reintroduced to a location outside of cabinet 102. In some embodiments, air may be in a continuous through-path through washing machine appliance 100.

Additionally or alternatively, inlet blower 214 and/or outlet blower 232 may be operated by controller 166 to direct air into and out of wash basket 120 to perform an air dry operation. Air dry operation may include rotating wash basket 120 using motor assembly 170 while moving air through wash basket 120 using inlet ducting 210, outlet ducting 230, and blowers 214 and 232. The air dry operation may be performed following a wash cycle. A user may cancel the air dry operation using control panel 160 or input selectors 162.

In some examples, the air dry operation may operate for a predetermined air dry operation time between about 2 and 10 hours. In some examples, the air dry operation time may be between about 2 and 7 hours. In some embodiments, the predetermined air dry operation time may be a preset value stored by controller 166. In some embodiments, the predetermined air dry operation time may vary based on the determined load size or expected moisture of the load of clothes in the wash basket 120. The expected moisture may be determined based on the type of wash cycle selected. For example, a wash cycle with a low spin speed may have more expected moisture in the load of clothes following completion of the wash cycle than a wash cycle with a high spin speed.

Air flowing into wash basket 120 using inlet ducting 210 may not be heated using a heater. Air flowing into wash basket 120 using inlet ducting 210 may be at an ambient temperature, or at a temperature similar to the temperature outside washing machine appliance 100. In some embodiments, air may pass by motor assembly 170 to add some heat from motor assembly 170 into the air prior to the air entering wash basket 120. Embodiments described herein may be a washing machine appliance without an air heater for heated drying capabilities. In this regard, the air dry operation time may be longer than what would typically be required by a heated dryer appliance, as no heater is used to heat air to dry the load of clothes.

Figure 3:
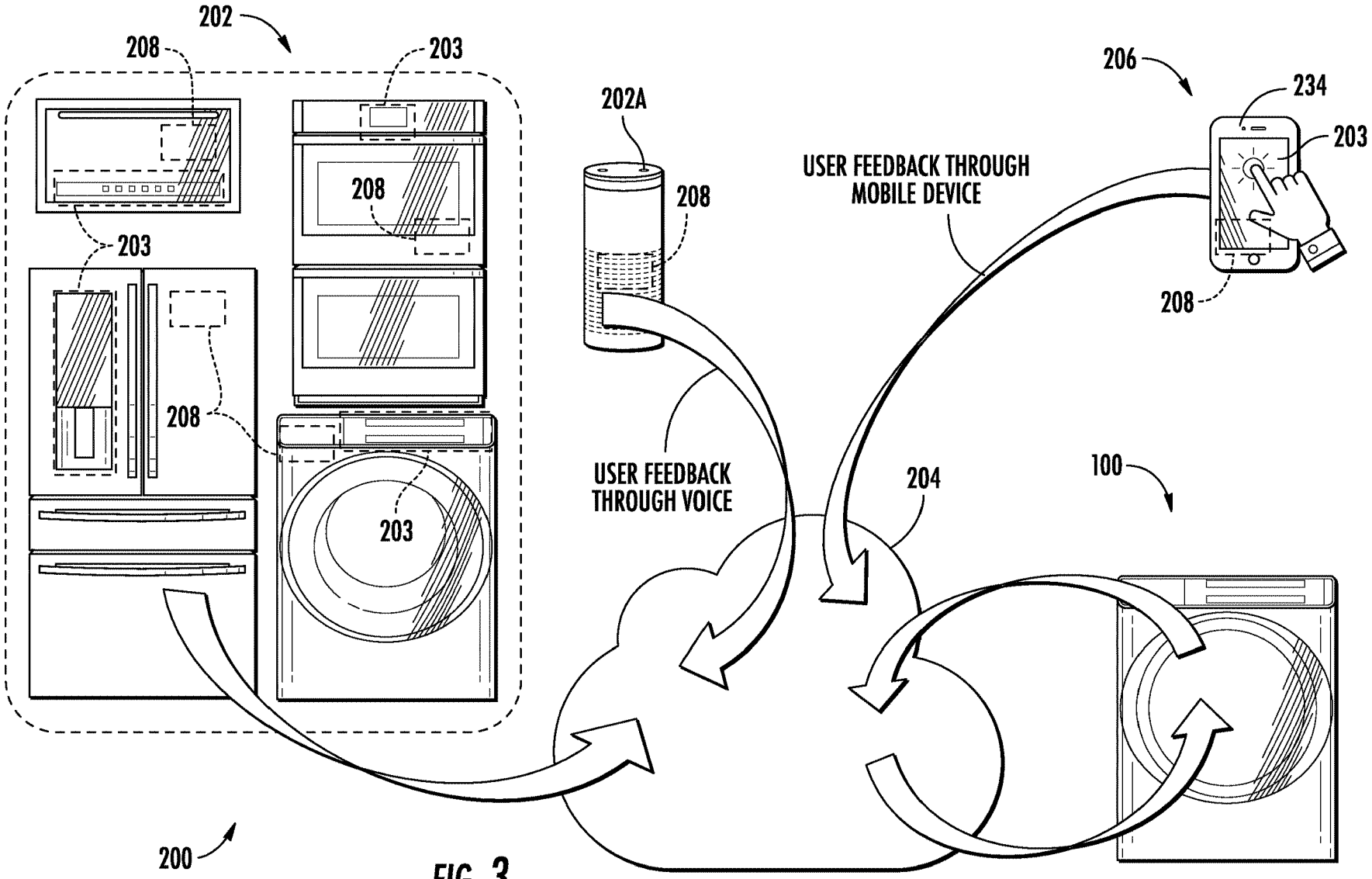
FIG. 3 provides a schematic view of a washing machine appliance alert system according to exemplary embodiments of the present disclosure.

FIG. 3 illustrates a washing machine appliance communication system 200 according to exemplary embodiments of the present subject matter. As shown, washing machine appliance communication system 200 generally includes washing machine appliance 100 and may include a communication device 202 (e.g., a device capable of communicating with washing machine appliance 100 through a remote network 204). It should be appreciated that the specific appliance types and configurations are only exemplary and are provided to facilitate discussion regarding the use and operation of an exemplary washing machine appliance communication system 200. The scope of the present subject matter is not limited to the number, type, and configurations of appliances set forth herein.

Communication device 202 may be a device capable of receiving user feedback and capable of communicating with washing machine appliance 100 over a remote network. For example, communication device 202 may be a household appliance, a remote user device, a voice activated connection device, etc. Communication device 202 may be a microwave, oven, range, dryer, refrigerator, dishwasher, or microwave appliance. Communication device 202 may be a "smart" appliance, with a controller and network interface (not shown) capable of communicating with remote network 204, remote server, or remote user device 206. Communication device 202 may be used to request user feedback from a user regarding an air dry operation, as will be described in more detail below.

In addition, it should be appreciated that washing machine appliance communication system 200 may include one or more external devices, e.g., devices that are separate from or external to the one or more appliances, and which may be configured for facilitating communications with various appliances or other devices. For example, according to exemplary embodiments of the present subject matter, the washing machine appliance communication system 200 may include or be communicatively coupled with a remote user device 206 that may be configured to enable user interaction with washing machine appliance 100 in the washing machine appliance communication system 200. In general, remote user device 206 may be any suitable device separate and apart from washing machine appliance 100 that is configured to provide and/or receive communications, information, data, or commands from a user. In this regard, remote user device 206 may be an additional user interface to the user interface panels of the washing machine appliance 100. In this regard, for example, the remote user device 206 may be a personal phone, a smartphone, a tablet, a laptop or personal computer, a wearable device, a smart home system, or another mobile or remote device. For example, the separate device may be a smartphone operable to store and run applications, also known as "apps," and the remote user device 206 be provided as a smartphone app. Additionally or alternatively, remote user device 206 may have access to or be operable to store information on one or more databases.

In addition, as will be described in more detail below, the washing machine appliance communication system 200 may include or be communicatively coupled with a remote server (not shown) through remote network 204 that may be in operative communication with remote user device 206 and/or some or all appliances within washing machine appliance communication system 200. Thus, remote user device 206 and/or remote server may refer to one or more devices that are not considered household appliances as used herein. In addition, devices such as a personal computer, a router, network devices, and other similar devices whose primary functions are network communication and/or data processing are not considered household appliances as used herein.

As illustrated, each of communication device 202, remote user device 206, or any other devices or appliances in washing machine appliance communication system 200 may include or be operably coupled to a controller, identified herein generally by reference numeral 208. As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 208 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 208 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 208 may be operable to execute programming instructions or micro-control code associated with an operating cycle of an appliance. In this regard, the instructions may be software or any set of instructions that when executed by the processing device, cause the processing device to perform operations, such as running one or more software applications, displaying a user interface, receiving user input, processing user input, etc. Moreover, it should be noted that controller 208 as disclosed herein is capable of and may be operable to perform any methods, method steps, or portions of methods as disclosed herein. For example, in some embodiments, methods disclosed herein may be embodied in programming instructions stored in the memory and executed by controller 208. For example, a controller 208 of system 200 may be a non-transitory computer readable medium comprising computer-executable instructions, which, when executed by one or more processors of a computing system may cause one or more processors to perform methods described herein (e.g., method 400 of operating a washing machine appliance, which will be described in more detail below). The memory devices may also store data that can be retrieved, manipulated, created, or stored by the one or more processors or portions of controller 208. The data can include, for instance, data to facilitate performance of methods described herein. The data can be stored locally (e.g., on controller 208) in one or more databases and/or may be split up so that the data is stored in multiple locations. In addition, or alternatively, the one or more database(s) can be connected to controller 208 through any suitable communication module, communication lines, or network(s).

Now that the construction of washing machine appliance communication system 200, washing machine appliance 100, communication device 202, and remote user device 206 have been presented according to exemplary embodiments, an exemplary method 400 of operating a washing machine appliance having a blower will be described. Although the discussion below refers to the exemplary method 400 of operating washing machine appliance 100, one skilled in the art will appreciate that the exemplary method 400 is applicable to the interconnectivity of any suitable number, type, and configuration of appliances or devices. In exemplary embodiments, the various method steps as disclosed herein may be performed by one or more controllers (e.g., such as controllers 208 or controller 166) or by a separate, dedicated controller that may be located locally on one or more of the appliances, remotely on a remote server, etc.

Figure 4:
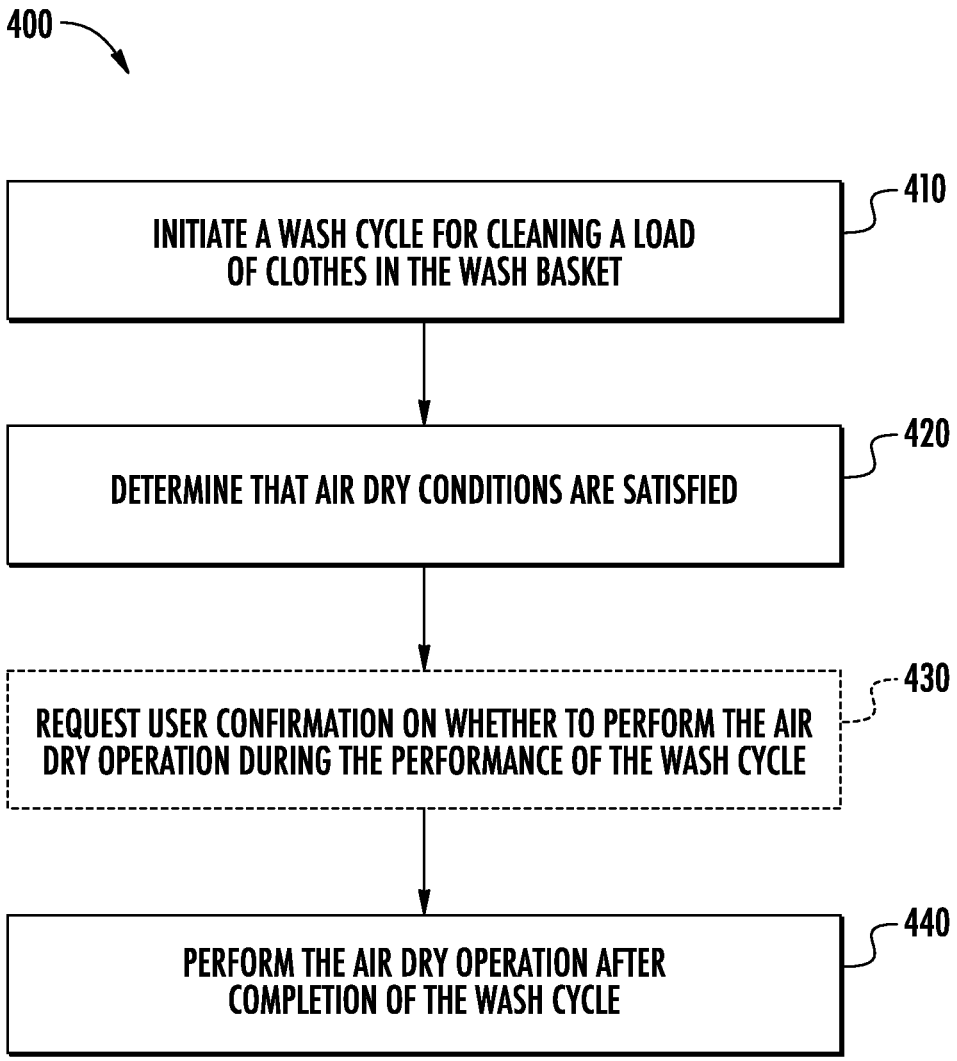
FIG. 4 provides a flow chart illustrating a method of alerting about a wash and air dry cycle for a washing machine appliance according to exemplary embodiments of the present disclosure.
Figure 5:
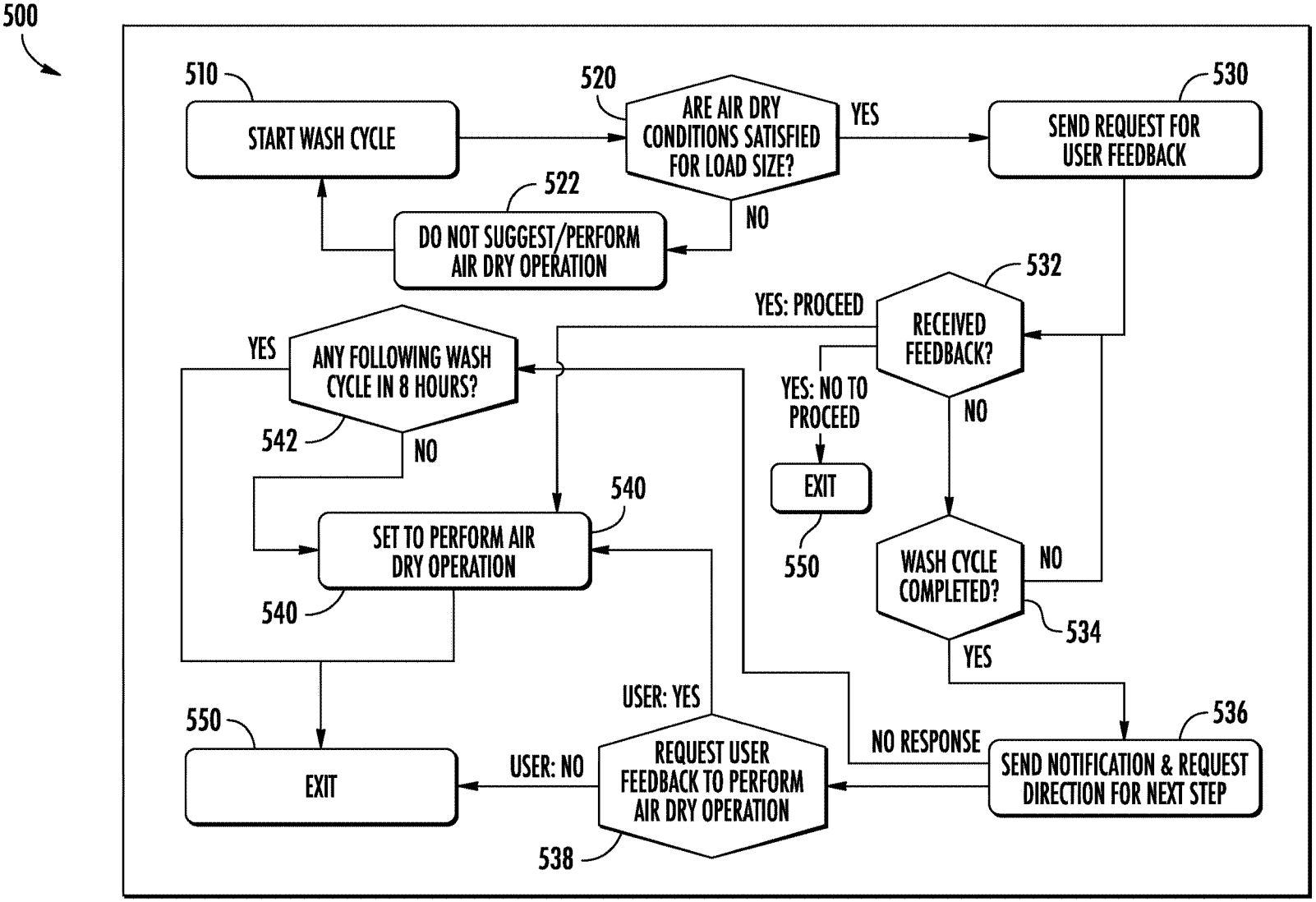
FIG. 5 provides a flow chart illustrating an exemplary method of alerting about a wash and air dry cycle for a washing machine appliance according to exemplary embodiments of the present disclosure.

Referring now to FIGS. 4 and 5, various methods (e.g., method 400 or method 500) may be provided for use with washing machine 100 and/or system 200 in accordance with the present disclosure. In some embodiments, all or some of the various steps of the method(s) may be performed by a suitable controller (e.g., controller 166). During such methods, controller 166 or 208 may receive inputs and transmit outputs from various other portions of the system 200. For example, controller 166 may send signals to and receive signals from another controller 208 to request feedback from a user. The present methods may advantageously allow more usage of available features of a washing machine appliance, as well as aid in the laundering of clothes such as uniforms overnight without having to move uniforms from the washing machine to the dryer to complete the laundering process.

FIGS. 4 and 5 depict steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

At step 410, the method 400 includes initiating a wash cycle for cleaning a load of articles, e.g., a load of clothes. Controller 166 may initiate the wash cycle for cleaning a load of clothes, including adding wash fluid to wash basket 120 and rotating wash basket 120 using motor assembly 170.

At step 420, the method 400 includes determining that air dry conditions are satisfied. Controller 166 may determine that air dry conditions are satisfied. In general, the "air dry conditions" may be selected by a user or programmed (e.g., as a factory setting) to correspond with at least one condition related to the user, the load of clothes, scheduling restraints, time restrictions, time requirements, etc., that when satisfied, indicate that an air dry operation is appropriate to be performed.

In some examples, the air dry conditions may include determining the size or type of the load of clothes. For example, step 420 of determining that air dry conditions are satisfied, includes detecting a load size of the load of clothes and determining that the load size is less than an air dry operation threshold load size. For example, detecting the load size may include determining a load weight of the load of clothes within wash basket 120 and determining the load weight is less than the air dry operation threshold weight.

For example, detecting the load size may be determined by analyzing an image from a camera to determine the load size. For example, controller 166 may be in operational communication with camera 180 and may direct camera 180 to take an image of an interior of wash basket 120. Controller 166 may receive the image of the interior of the wash basket 120 and may further analyze the image to determine the load size of the load of clothes in wash basket 120.

In some examples, controller 166 may receive an image of the load of clothes by an external camera, e.g., a camera 234 on remote user device 206. Controller 166 or 208 may analyze the image to determine the load size of the load of clothes in wash basket 120.

For example, detecting the load size may be determined by performing a load-based torque measurement of the wash basket rotation. A sensor (not shown) may be coupled to wash basket 120 to determine the torque measurement during rotation by the motor assembly 170. The load size may be determined to be larger with a larger torque measurement, or in other words, increased force may be measured with increased load size. In some embodiments, torque measurement may be measured directly, or may be converted to a load weight or load size to determine whether the load size is less than the air dry operation threshold load size.

In some examples, the air dry operation threshold load size may be a weight of less than 10 pounds. In some examples, the air dry operation threshold load size may be a weight of less than 5 pounds. In some examples, the air dry operation threshold load size may be a weight of less than 4 pounds.

Additionally or alternatively, determining that the air dry conditions are satisfied includes determining that no subsequent wash cycle is scheduled to be performed for at least a predetermined air dry operation time following the completion of the wash cycle. For example, this may include receiving user feedback confirming no subsequent wash cycle is scheduled to be performed within the predetermined air dry operation time.

Controller 166 may request user feedback that requests if a wash cycle is scheduled to be performed within the predetermined air dry operation time. User feedback may be requested using control panel 160 or input selectors 162, or user feedback may be requested on a remote user device 206 or on a communication device 202 over remote network 204. User feedback may be received by controller 166 using remote network 204 if sent via a remote device (e.g., remote user device 206 or a communication device 202). As previously mentioned, the predetermined air dry operation time may be the time to operate the washing machine appliance 100 in an air dry operation comprising wash basket 120 rotation and air flow using at least one blower 214, 232 and at least one ducting 210, 230 to dry the load of clothes in wash basket 120.

In some examples, determining that no subsequent wash cycle is scheduled to be performed within the predetermined air dry operation time includes reviewing a user calendar. The user calendar may be a cloud based or remote calendar. Controller 166 may access the user calendar using remote network 204. Controller 166 may review the user calendar to determine if no subsequent wash cycle is scheduled. For example, controller 166 may review the user calendar and determine no scheduled activities for the predetermined air dry operation time to determine no subsequent wash cycle is scheduled to be performed. For example, controller 166 may review the user calendar and determine no work, sports, or uniform-wearing activities are scheduled within the predetermined air dry operation time. Uniform-wearing activities may be a preset factory setting for reviewing the calendar or may be set by the user.

In additional or alternative embodiments, determining that no subsequent wash cycle is scheduled to be performed within the predetermined air dry operation time includes analyzing prior wash cycle time data. Controller 166 may record a time when wash cycles are performed and may review that data. Controller 166 may keep each record of wash cycles to create the prior wash cycle time data. The prior wash cycle time data may be used to determine if it is likely the user will perform another wash cycle within the predetermined air dry operation time.

For example, if a user typically washes three loads in succession weekly, the prior wash cycle time data would indicate that three loads are likely to be performed at a current time, and if a current wash load was the third load of the day, controller 166 may determine that no subsequent wash cycle is scheduled to be performed within the predetermined air dry operation time. In turn, if the current wash load is the first or second load of the day, controller 166 may determine that a wash cycle is scheduled to be performed and that the air dry conditions are not satisfied. For example, if the prior wash cycle time data indicates that one load is washed daily, controller 166 may again determine that no subsequent wash cycle is scheduled to be performed within the predetermined air dry operation time.

Optionally, the step of determining that no subsequent wash cycle is scheduled to be performed within the predetermined air dry operation time includes determining whether a time at the initiation of the wash cycle falls within an evening time period, or any other time period when the initiation of a subsequent wash cycle is unlikely (e.g., work hours, etc.). Controller 166 may include a clock, to determine a current time. Controller 166 may further determine the time at the initiation of the wash cycle (e.g., the wash cycle initiated at step 410). Controller 166 may determine that no subsequent wash cycle is scheduled to be performed within the predetermined air dry operation time period if the time at the initiation of the wash cycle is within an evening time period. Advantageously, the evening time period may indicate that the user of washing machine appliance 100 is unlikely to perform another load prior to night time, and therefore, operation of the air dry operation would be desirable.

Evening hours may be a predetermined time period saved by the controller 166. In some examples, evening hours may be between about 5 p.m. and 12:00 a.m. In some examples, evening hours may be between about 6 p.m. and 11:00 p.m. Other evening hours may be preset depending on the needs of the embodiment.

In some examples, if the wash cycle start time is determined to be within evening hours, controller 166 may determine that no subsequent wash cycle is scheduled to be performed within the predetermined air dry operation time. Controller 166 may further determine that air dry conditions are satisfied by the wash cycle start time being within the evening hours.

Additionally or alternatively, determining that the air dry conditions are satisfied includes obtaining an image of the load of clothes from a camera (e.g., camera 180 or external camera 234) and determining the load of clothes includes a uniform. In some embodiments, controller 166 may direct camera 180 to obtain an image of the load of clothes in wash tub 120. Controller 166 may receive the image of the load of clothes from camera 180. In some embodiments, controller 166 may receive an image of the load of clothes from external camera 234. Controller 166 may analyze the image of the load of clothes to determine if a uniform is included in the load of clothes. Controller 166 may determine if a uniform is included in the load of clothes by comparing the image to images of uniforms, as would be understood.

In some embodiments, air dry conditions may include one or more of the aforementioned determination steps, e.g., any steps determining that the air dry conditions are satisfied or determining that no subsequent wash cycle is scheduled to be performed within the predetermined air dry operation time.

Optionally, at step 430, the method 400 may include requesting user confirmation on whether to perform the air dry operation during the performance of the wash cycle. Controller 166 may further be configured to request a user confirmation on whether to perform the air dry operation, the request being sent during the performance of the wash cycle. Controller 166 may request the user confirmation on the washing machine appliance 100 using a user interface of machine appliance 100 (e.g., control panel 160 or input selectors 162).

In some examples, controller 166 may request the user confirmation using at least one communication appliance 202 (e.g., a household appliance remotely connected to washing machine appliance 100). A user interface 203 (e.g., a graphical user interface) may be used to request the user confirmation. Controller 166 may be in operative communication with user interface 203 or may communicate with controller 208 and controller 208 may be in operative communication with user interface 203. The user may use user interface 203 to respond to the user confirmation request.

In some examples, controller 166 may request the user confirmation using a voice activated connection device, such as communication appliance 202A. Controller 166 may request an audio message requesting user confirmation. Controller 166 may be in operative communication with user interface 203 or may communicate with controller 208 and controller 208 may be in operative communication with user interface 203. The user may respond to the user confirmation request with an audible answer.

In some examples, controller 166 may request the user confirmation using remote user device 206. Remote user device 206 may have a user interface 203 for communication between the user and controller 208. User interface 203 (e.g., a graphical user interface) may be used to request the user confirmation. Controller 166 may be in operative communication with user interface 203 or may communicate with controller 208 and controller 208 may be in operative communication with user interface 203. The user may use user interface 203 to respond to the user confirmation request.

At step 440, the method 400 includes performing the air dry operation after completion of the wash cycle. Controller 166 may direct the performance of the air dry operation of washing machine appliance 100 following the wash cycle if the air dry conditions are satisfied. In some embodiments, washing machine appliance 100 may proceed with the air dry operation upon receipt of user input to perform the air dry operation (e.g., in response to the user confirmation request of step 430). Performance of the air dry operation may be performed automatically upon completion of the wash cycle.

The air dry operation may include operating a blower (e.g., at least one of blower 214 and 232) to circulate air within wash basket 120 and operating motor assembly 170 to tumble the load of clothes. The air dry operation may be as herein otherwise described, including circulating air into and out of wash basket 120 for a period of several hours.

Additionally or alternatively, controller 166 may be configured to perform the air dry operation after completion of the wash cycle upon receiving no user input on whether to perform the air dry operation prior to the completion of the wash cycle. If no user input is received following the request for user confirmation, and the air dry conditions are satisfied, controller 166 may automatically perform the air dry operation following completion of the wash cycle. Advantageously, automatically performing the air dry cycle absent any communication from the user allows the washing machine to be used to greater capacity, as the load of clothes will be automatically washed and dried instead of sitting, perhaps for hours, before the user remembers and returns to switch the load of clothes into the dryer. The features of the washing machine are utilized, and the user does not have to actively choose the feature to reap its benefits.

In some embodiments, user feedback may be received prior to the completion of the wash cycle. In some embodiments, controller 166 may further be configured to determine that air dry operation conditions have not been met upon receiving user feedback to not perform the air dry operation within the wash basket. For example, if the controller receives user feedback that the load is too large, that a second load is scheduled within the predetermined air dry operation time, that the air dry operation is refused or not wanted, the controller determines that the air dry operation conditions have not been met. In such circumstances, controller 166 is configured to end operation of washing machine appliance 100 following determining that air dry operation conditions have not been met upon receiving user feedback to not perform the air dry operation within the wash basket 120. Controller 166 ends operations upon completion of the wash cycle, as directed by the user feedback. Optionally, controller 166 may further be configured to receive a request to cancel the air dry operation following performing the air dry operation. For example, if no user feedback is received and controller 166 begins the air dry operation following completion of the wash cycle, the user may request to cancel the air dry operation. The user may use the user interface (e.g., control panel 160 or input selectors 162) to perform this request. Controller 166 receives the cancellation request from the user interface. In response to receiving the request to cancel the air dry operation following performing the air dry operation, controller 166 cancel the air dry operation of washing machine appliance 100. Advantageously, the user maintains the ability to remove the load of clothes from wash basket 120 even upon automatic performance of the air dry operation.

In some embodiments, controller 166 may request user feedback following the completion of the wash cycle, notifying the user that the air dry operation will be automatically started In FIG. 5, an example flow chart of a method 500 is shown. At step 510, a wash cycle is started by controller 166 in washing machine appliance 100. At step 520, controller 166 determines if air dry conditions are satisfied regarding a load size for the load of clothes in the washing machine appliance 100. If the load size conditions are not satisfied, controller 166 does not proceed or suggest the performance of the air dry operation at 522.

At step 530, controller 166 sends a request for user feedback. The request may be made using washing machine appliance 100, communication device 202 (including communication device 202A), and/or remote user device 206. At step 532, controller 166 determines if feedback has been received. If feedback has not been received, at step 534, controller 166 determines if the wash cycle has been completed. If not, controller 166 returns to checking if feedback has been received at step 532. If feedback has been received, and the feedback is to proceed, controller 166 proceeds to step 540, setting the washing machine appliance 100 to perform the air dry operation following completion of the wash cycle. If feedback has been received and the feedback is to not proceed, controller 166 proceeds to exit or not perform the air dry operation at step 550.

If the wash cycle has been completed at step 534, controller 166 proceeds to step 536 and sends a final notification to request feedback from the user. This final notification at step 536 may be made using washing machine appliance 100, communication device 202 (including communication device 202A), and/or remote user device 206.

If no response is received (e.g., within a final response time period) at step 536, controller 166 proceeds to check if a second air dry condition is met or whether a wash cycle is scheduled within a predetermined air dry operation time at step 542. In this example, a time of about 8 hours is set as the predetermined air dry operation time. If a wash cycle is scheduled within the predetermined air dry operation time, controller 166 proceeds to exit at step 550. If no wash cycle is scheduled within the predetermined air dry operation time, controller 166 proceeds to step 540 and starts the air dry operation following completion of the wash cycle.

If user feedback is received at step 538, and if that feedback is a "yes" or feedback to proceed with the air dry operation, controller 166 proceeds to step 540 and starts the air dry operation following completion of the wash cycle. If the user feedback is received at step 538 and if that feedback is a "no" or feedback not to proceed with the air dry operation, controller 166 proceeds to exit and does not begin the air dry operation in washing machine 100 at step 550.

If controller 166 proceeds to step 540 and starts the air dry operation following completion of the wash cycle, controller 166 proceeds to the exit step at 550, ending the washing machine operation upon completion of the air dry operation at step 540.

Embodiments described herein may include a method of selecting a 1-Step Wash & Dry cycle automatically based on self-detection and consumer feedback. A clothes washer automatically selects 1-Step Wash & Dry cycle upon meeting air dry conditions. Air dry conditions may include a smaller load detection that may be detected by either the washer performing a load-based torque measurement or through a camera (either mobile or on-board). Air dry conditions may include ensuring no subsequent wash cycles are needed within a predetermined time period. This may be achieved by user feedback, the time of day (late evening), or based on artificial intelligence and prior cycle start time history. Air dry conditions may include ensuring that a user does not need the washed clothes as soon as possible. This may be estimated by interacting with the user's cloud-based calendar. It may also be based on an image of the load and noticing it is some sort of uniform (e.g., a uniform for sports, school, job, etc.).

In some embodiments, if the clothes washer receives no feedback from the user, the controller may add an air drying cycle (e.g., an 8-hour dry cycle) after the wash cycle is completed. During the air drying cycle, the clothes may be removed at any time by pressing pause or power to cancel the air drying cycle.

In addition, the method may also propose flexibility in selecting or cancelling a 1-Step Wash & Dry cycle at different stages of wash & dry process. For example, a user may select 1-Step Wash & Dry cycle just before completion of washing or a user may cancel the 1-Step Wash & Dry cycle after washing to gain access to the clothes load prior to completion of the air dry cycle. Such may be useful to manually move the clothes to a separate dryer appliance (e.g., one that uses heat to dry clothes) to get the clothes dried more quickly than the air drying cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a wash tub positioned within a cabinet;

a wash basket rotatably mounted within the wash tub and defining a wash chamber for receiving a load of clothes;

a blower operably coupled to the wash basket and being configured to introduce air into the wash basket;

a motor assembly mechanically coupled to the wash basket for selectively rotating the wash basket; and a controller in operative communication with the blower and the motor assembly, the controller being configured to:

initiate a wash cycle for cleaning the load of clothes;

determine that air dry conditions are satisfied;

request a user confirmation on whether to perform an air dry operation during performance of the wash cycle; and perform the air dry operation after completion of the wash cycle in response to determining that the air dry conditions are satisfied and upon receipt of the user confirmation, the air dry operation comprising operating the blower to circulate the air within the wash basket and operating the motor assembly to tumble the load of clothes.

2. The washing machine appliance of claim 1, wherein determining that the air dry conditions are satisfied comprises:

detecting a load size of the load of clothes; and determining that the load size is less than an air dry operation threshold load size.

3. The washing machine appliance of claim 2, wherein the load size of the load of clothes is determined by analyzing an image from a camera.

4. The washing machine appliance of claim 2, wherein the load size of the load of clothes is determined by performing a load-based torque measurement of the wash basket rotation.

5. The washing machine appliance of claim 1, wherein determining that the air dry conditions are satisfied comprises determining that no subsequent wash cycle is scheduled to be performed for at least a predetermined air dry operation time following the completion of the wash cycle.

6. The washing machine appliance of claim 5, wherein determining that no subsequent wash cycle is scheduled to be performed within the predetermined air dry operation time comprises receiving user feedback confirming no subsequent wash cycle is scheduled to be performed within the predetermined air dry operation time.

7. The washing machine appliance of claim 5, wherein determining that no subsequent wash cycle is scheduled to be performed within the predetermined air dry operation time comprises reviewing a user calendar.

8. The washing machine appliance of claim 5, wherein determining that no subsequent wash cycle is scheduled to be performed within the predetermined air dry operation time comprises analyzing prior wash cycle time data.

9. The washing machine appliance of claim 5, wherein determining that no subsequent wash cycle is scheduled to be performed within the predetermined air dry operation time comprises determining whether a time at the initiation of the wash cycle falls within an evening time period.

10. The washing machine appliance of claim 1, wherein determining that the air dry conditions are satisfied comprises obtaining an image of the load of clothes from a camera and determining the load of clothes comprises a uniform.

11. The washing machine appliance of claim 1, wherein the controller requests the user confirmation on whether to perform the air dry operation on at least one of: a household appliance remotely connected to the washing machine appliance, a voice activated connection device, a user interface of the washing machine appliance, or a remote user device.

12. The washing machine appliance of claim 1, wherein the controller is further configured perform the air dry operation after the completion of the wash cycle upon receiving user input to perform the air dry operation or receiving no user input on whether to perform the air dry operation prior to the completion of the wash cycle.

13. The washing machine appliance of claim 1, wherein the controller is further configured to determine that air dry operation conditions have not been met upon receiving user feedback to not perform the air dry operation within the wash basket; and end operation of the washing machine appliance following determining that air dry operation conditions have not been met upon receiving user feedback to not perform the air dry operation within the wash basket.

14. The washing machine appliance of claim 1, wherein the controller is further configured to:

receive a request to cancel the air dry operation following performing the air dry operation; and cancelling the air dry operation of the washing machine appliance.

* * * * *